US005626029A

United States Patent [19]

Lilja

[11] Patent Number: 5,626,029

[45] Date of Patent: May 6, 1997

[54] ARRANGEMENT FOR FURNISHING REFRIGERATED OR FROZEN GOODS

[75] Inventor: Gunnar Lilja, Arvika, Sweden

[73] Assignee: Aktiebolaget Electrolux, Stockholm, Sweden

[21] Appl. No.: 540,124

[22] Filed: Oct. 6, 1995

[30] Foreign Application Priority Data

Dec. 7, 1994 [SE] Sweden ..... 9404252

[51] Int. Cl.[6] ..... A47F 3/04; F25D 17/04

[52] U.S. Cl. ..... 62/256; 62/407

[58] Field of Search ..... 62/256, 246, 405, 62/407, 371

[56] References Cited

U.S. PATENT DOCUMENTS

| | | | |
|---|---|---|---|
| 2,967,404 | 1/1961 | Detwiler | 62/246 |
| 3,593,538 | 7/1971 | Bachman et al. | 62/256 |
| 4,165,620 | 8/1979 | Gehauf Nee Kiesel et al. | 62/256 |
| 4,663,943 | 5/1987 | Dyment et al. | 62/250 |
| 4,668,028 | 5/1987 | Kimoto | 312/116 |
| 4,794,764 | 1/1989 | Dyment et al. | 62/250 |
| 5,058,393 | 10/1991 | Callon et al. | 62/255 |

FOREIGN PATENT DOCUMENTS

| | | |
|---|---|---|
| 91692 | 11/1961 | Denmark . |

*Primary Examiner*—William Doerrler

*Attorney, Agent, or Firm*—Pearne, Gordon, McCoy & Granger

[57] ABSTRACT

An arrangement for furnishing refrigerated or frozen goods (14) includes a container (12) with at least one compartment (13), which is filled with the goods from above and at the bottom, has an opening (18) through which goods are removed. The container (12) is surrounded by a hood (22). The goods are refrigerated by circulating air (34, 36). A first portion of the circulating air is brought to flow in a gap (24) between the container (12) and the hood (22) and after that in an air curtain (38) over the opening (18). A remaining portion of the circulating air flows through the compartment (13) and is reunited with the first portion of circulating air at the opening (18).

8 Claims, 2 Drawing Sheets

ARRANGEMENT FOR FURNISHING REFRIGERATED OR FROZEN GOODS

BACKGROUND OF THE INVENTION

The invention relates to an arrangement for dispensing refrigerated or frozen goods using a magazine, which is filled or loaded with the goods from above and, at a bottom, has an opening for taking out the goods. The magazine is surrounded by a casing and the goods are refrigerated by cold air circulated inside the casing.

Such an arrangement is known through U.S. Pat. No. 4,663,943 where the goods are dispensed through an opening which is covered by a door on the casing. The door prevents the refrigerating air from leaking out through the opening.

SUMMARY OF THE INVENTION

An object of the present invention is to simplify the known arrangement so that the door can be spared, which makes it easier for a customer to remove the goods, without refrigerating air leaking or flowing through the opening.

This object is obtained through the arrangement according to the invention whereby the magazine is constituted by a container with at least one compartment, an opening is arranged in the container, and circulating air is flows through a gap between the container and the casing and in an air curtain over the opening.

BRIEF DESCRIPTION OF THE DRAWINGS

Embodiments of arrangements according to the present invention are described below in connection with the enclosed drawings, in which.

DETAILED DESCRIPTION OF THE PREFERRED EMBODIMENTS

Figure 1:
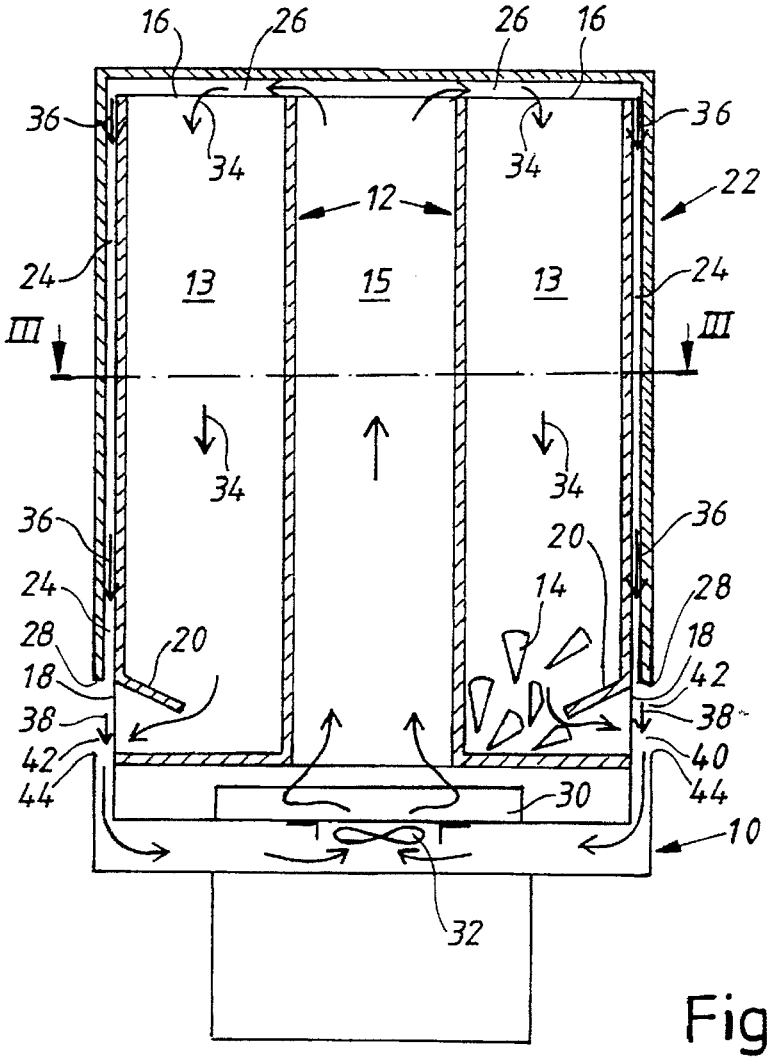
FIG. 1 is a longitudinal sectional view of the arrangement with compartments for goods.

With reference to the drawing figures and, in particular, FIG. 1, an underbody 10, on which a container 12 with eight compartments 13 for goods 14, e.g. ice-cream cornets, and a central chamber 15, is arranged. Each respective compartment 13 has at a top thereof, an opening 16 for refilling of goods and, at the bottom thereof, an opening 18 for taking goods out. A baffle 20 arranged above the opening 18 prevents the goods 14 from falling out through the opening 18. A hood 22 is arranged over the container 12, and at a distance from the container, so that a vertical gap 24 is formed between the sides of the container 12 and the hood 22 and a gap 26 is formed between the upper edges of the container 12 and the hood 22. The hood 22 shows a lower edge 28, which is located at the same level as the upper edge of the opening 18.

The goods 14 are refrigerated by circulating air which, in turn, is refrigerated by an evaporator 30 of a refrigerating apparatus (not shown) arranged in the underbody 10. A fan 32 blows the air through the evaporator 30 and upwardly through the chamber 15, and into the gap 26 between the upper edges of the container and the hood 22. From the gap 26, the air splits up into a first flow 34, which goes through the compartments 13, and a second flow 36, which goes through the gap 24. The second flow 36 leaves the gap 24 at the edge 28 and continues as an air curtain 38 past the opening 18 to an air inlet gap 40 of the underbody, from where the air is drawn further on to the fan 32.

The container 12 and the hood 22 are preferably made of a transparent material to enable a customer can see the goods 14 in the compartments 13. New goods can be filled into the compartments 13 after the the hood 22 has been lifted off or after a lid (not shown) in the upper part of the hood 22 has been opened. The hood 22 is given a heat insulated structure, e.g. by its walls being made of glass or plastic in several layers with an air gap between the layers.

Figure 3A:
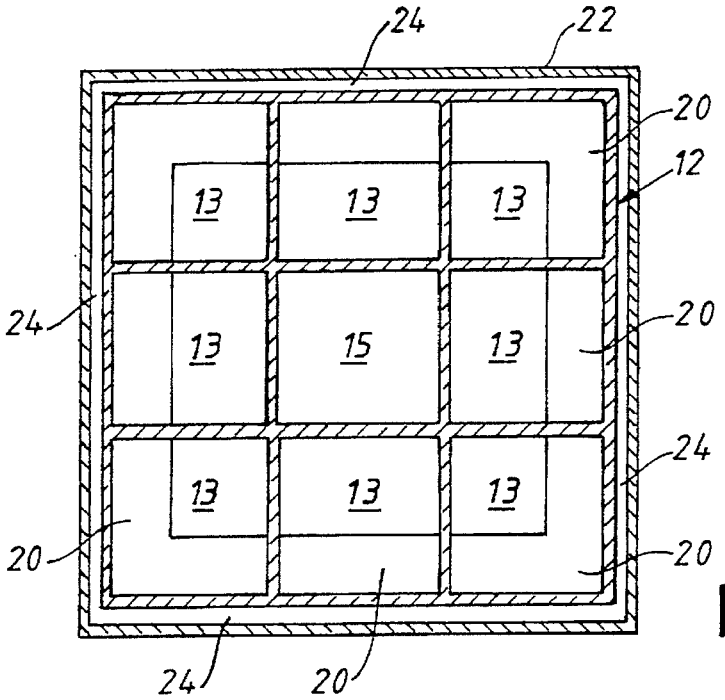
FIG. 3A is a sectional view as seen along line III—III in FIG. 1 according to a first embodiment of the present invention.
Figure 3B:
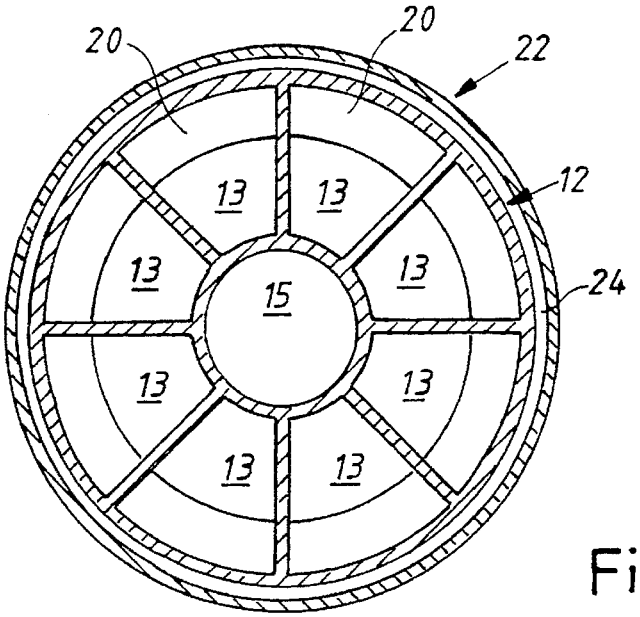
FIG. 3B is a sectional view as seen along line III—III in FIG. 1 of a second embodiment of the present invention.
Figure 2:
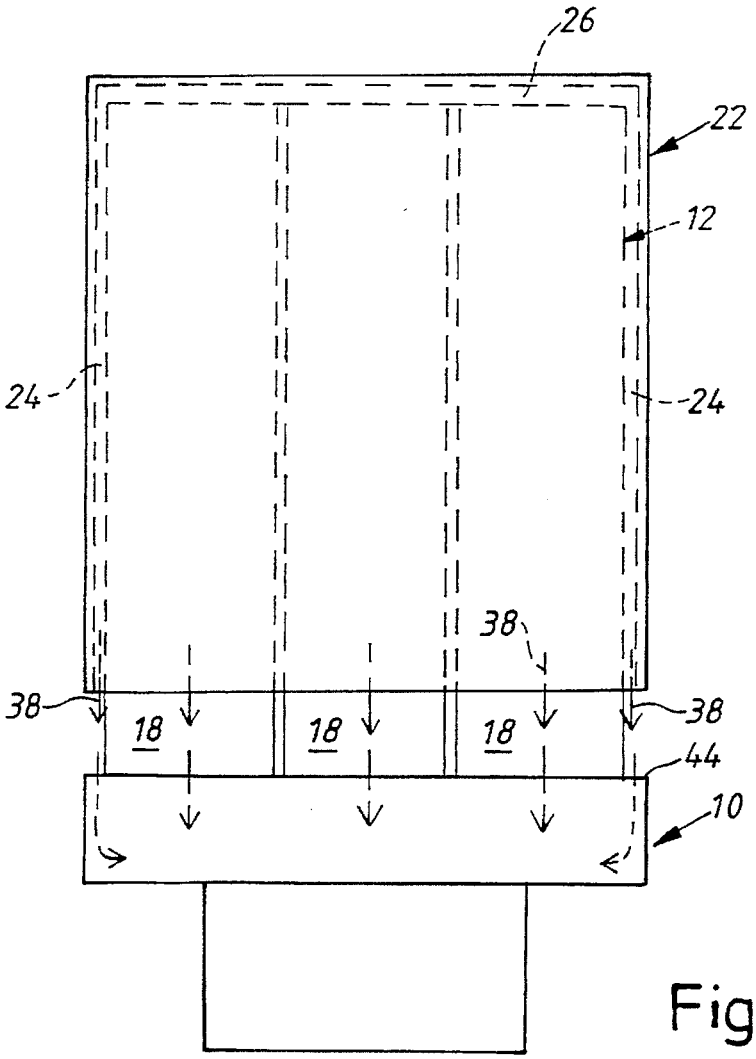
FIG. 2 is a view according to the marking II in FIG. 1.

The compartments 13 can have a rectangular or square cross sectional shape (FIG. 3A), and the hood 22 can have a corresponding cross-sectional shape. The compartments 13 can also have a sector-like or wedge-like cross-sectional shape as the compartments (FIG. 3B), and the hood 22 can have a circular cross-sectional shape.

When one of the goods 14 is taken out it first passes through the opening 18, then through the air curtain 38 and after that through an opening 42, which is formed between the lower edge 28 of the hood and an outer edge 44 of the air inlet gap 40 in the underbody 10. The air flows 34 and 36 join each other in the air inlet gap 40. In the embodiment in FIG. 3B the edge 44 is circular.

The walls of the container 12 between the compartments 13 can be made movable, through which the size of the compartments 13 can be changed. In order that the air flow 34 shall not steal too much air from the flow 36 and by that from the air curtain 38, the flow 34 can be restricted by a lid being put over the opening 16 and the air instead being allowed to flow into the compartment 13 through small openings taken up in its wall against the chamber 15.

I claim:

1. Arrangement for dispensing refrigerated or frozen goods (14) including a magazine (12) which is filled with goods from above and, at a bottom, defines an opening (18) through which goods are taken out of the magazine, the magazine being surrounded by a casing (22) covering a top and sides of the magazine and the goods being refrigerated by air (34, 36) circulated inside the casing, wherein the magazine is constituted by a container (12) with at least one compartment (13), the opening (18) is located at a bottom of the container (12) and a portion of the circulating air flows through a gap (24) between the container (12) and the casing (22) and then in an air curtain (38) over the opening (18).

2. Arrangement according to claim 1, wherein an other portion of the circulating air (34) flows through the compartment (13).

3. Arrangement according to claim 2, wherein said other portion of the circulating air (34) flowing through the compartment (13) leaves the compartment and joins the air curtain (38).

4. Arrangement according to any of the preceding claims, wherein the casing is constituted by a hood (22) which is placed over the container (12).

5. Arrangement according to any of claims 1, 2 or 3, wherein the container defines a plurality of compartments, and said compartments are arranged adjacent to each other around a central chamber (15).

6. Arrangement according to claim 5, wherein each compartment has a rectangular or quadratic cross section.

7. Arrangement according to claim 5, wherein each compartment has a sector-like cross section.

8. Arrangement according to claim 1, wherein the container (12) and the casing (22) are transparent to permit a consumer to directly view the goods.

* * * * *

UNITED STATES PATENT AND TRADEMARK OFFICE

CERTIFICATE OF CORRECTION

PATENT NO. : 5,626,029

DATED : May 6, 1997

INVENTOR(S) : Lilja

It is certified that error appears in the above-indentified patent and that said Letters Patent is hereby corrected as shown below:

On the title page, the title should read:

"ARRANGEMENT FOR DISPENSING REFRIGERATED OR FROZEN GOODS".

Column 1, the title should read "ARRANGEMENT FOR DISPENSING REFRIGERATED OR FROZEN GOODS".

Column 2, line 16, delete "as the".

Signed and Sealed this

FourthDay of August, 1998

Bruce Lehman

*Attest:*

BRUCE LEHMAN

*Attesting Officer*

*Commissioner of Patents and Trademarks*